United States Patent [19]

Shows, Jr. et al.

[11] Patent Number: 4,715,625

[45] Date of Patent: Dec. 29, 1987

[54] LAYERED PIPE SLIPS

[75] Inventors: Jess W. Shows, Jr., Maurice; Asadollah Hayatdavoudi, Lafayette, both of La.

[73] Assignee: Premiere Casing Services, Inc., Lafayette, La.

[21] Appl. No.: 786,950

[22] Filed: Oct. 10, 1985

[51] Int. Cl.[4] ..... B65H 59/10

[52] U.S. Cl. ..... 285/145; 188/67

[58] Field of Search ..... 285/144, 145, 146, 147, 285/148; 166/85; 175/423; 188/67

[56] References Cited

U.S. PATENT DOCUMENTS

| | | | |
|---|---|---|---|
| Re 19,587 | 5/1935 | Archer | 285/22 |
| 1,017,305 | 2/1912 | McBride | 285/144 |
| 1,188,489 | 6/1916 | Rhea . | |
| 1,234,041 | 7/1917 | Knapp | 175/423 |
| 1,343,426 | 6/1920 | Wright | 166/85 |
| 1,344,922 | 6/1920 | Mildren | 166/85 |
| 1,794,662 | 3/1931 | Zerr . | |
| 1,838,439 | 12/1931 | O'Brien | 175/423 |
| 1,884,874 | 10/1932 | Ross | 166/77.5 |
| 2,173,079 | 9/1939 | Moody | 188/67 |
| 2,623,257 | 12/1952 | Moon | 188/67 |
| 3,052,943 | 9/1962 | Jones | 285/144 |
| 3,094,852 | 6/1963 | Taylor | 64/1 |
| 3,154,146 | 10/1964 | Brown | 166/77.5 |
| 3,329,448 | 7/1967 | Allen | 285/147 |
| 3,330,354 | 7/1967 | Chamblee | 166/46 |
| 3,422,524 | 1/1969 | Timmons | 29/429 |
| 3,472,535 | 10/1969 | Kinley | 285/145 |
| 3,579,752 | 5/1971 | Brown | 188/67 |
| 3,748,702 | 7/1973 | Brown | 188/67 |
| 3,915,244 | 10/1975 | Brown | 175/85 |
| 4,162,704 | 7/1979 | Gunther | 166/77.5 |
| 4,355,443 | 10/1982 | Blackwell | 188/67 |
| 4,450,606 | 5/1984 | Broussard | 188/67 |

*Primary Examiner*—Randolph A. Reese
*Assistant Examiner*—Anthony Knight
*Attorney, Agent, or Firm*—Laney, Dougherty, Hessin & Beavers

[57] ABSTRACT

An apparatus for supporting pipe includes a support member defining an inner bowl surface in which is received a plurality of layers of arcuate slip segments. Preferably, the slip segments of each layer are staggered relative to the slip segments of adjacent layers.

27 Claims, 11 Drawing Figures

10
12
14
16
18
20
22
24
26
34
39
58
62
64
70
80
84
86
88
90
116
120
124
126
136
138
140
142
144
146
148

LAYERED PIPE SLIPS

BACKGROUND AND SUMMARY OF THE INVENTION

The instant invention pertains to apparatus for holding pipe in a vertical position and more particularly to such apparatus which does so using a set of pipe slips.

In the drilling of oil and gas wells, it is necessary to thread together numerous lengths of pipe to form a drill string which rotates a bit at the bottom thereof. During drilling, at least some of the weight of the pipe string is supported by a block and tackle arrangement suspended from a mast which extends upwardly from the floor of the drilling rig.

When it is necessary to add an additional pipe to the top of the drill string, rotary action of the drill string is stopped and it is suspended at the floor of the drilling rig while an additional pipe is threadably connected to the uppermost pipe in the drill string. The drill string is typically suspended by a so-called spider which is mounted on the floor of the drilling rig and through which the drill string extends. The spider is essentially a bowl having a hole at the lower end thereof through which the pipe at the upper end of the drill string extends. The bowl includes a tapered surface and a plurality of arcuate slip segments which also include tapered surfaces that abut against and are slidable along the tapered surface in the bowl. Each slip segment includes gripping elements directed toward the pipe. When the segments are received in the bowl about the circumference of the pipe and the pipe is lowered, camming action between the segments and the bowl jams the segments into the pipe thus suspending it from the spider.

When the pipe is so suspended, an additional joint of pipe is threadably engaged with the uppermost pipe on the drill string, the slip segments are removed, and rotary motion is again applied to the drill string to continue drilling.

During drilling, it may be necessary to remove the drill string to change the bit, to add casing to a portion of the well bore, or for other reasons. When removing the drill string, rotary motion is stopped and the drill string is suspended in the spider. Thereafter, an elevator which is suspended from the traveling block in the block and tackle arrangement is used to grip the pipe just above the spider and the spider slip segments are removed. The traveling block is raised, the spider slips are reset and the stand of pipe extending above the drilling rig floor is unthreaded and removed. Thereafter, the elevator grasps the pipe extending from the spider, the spider slip segments are again removed, and the traveling block again raised. This process is repeated until the drill string is removed from the bore.

The elevator, like the spider, includes arcuate slip segments which are received in a bowl which tends to cam the segments into the pipe in order to provide a tight gripping action.

Several problems exist with the prior art spiders and elevators. Because of slight amounts of uneveness which may exist on the radially outer surface of a drill pipe, it is possible for one of the slip segments to abut against the pipe so that the gripping elements formed on the slip segment are not uniformly loaded. Unevenness in loading tends to concentrate forces against the pipe and in a severe case may amount to point loading. When supporting a drill string which may be several miles in length, such loading can cause pipe failure which permits the drill string to fall in the bore.

Another problem with prior art elevators and spiders is that there is a substantial gap between adjacent slip segments when such are received in the bowl to support the pipe. Thus, between adjacent slip segments there is a vertical gap against which gripping elements are not abutted. When supporting several miles of drill string, the radially inward pressure of all of the gripping elements tends to cause the pipe to bulge into the verticle gaps. Such bulging can cause pipe failure.

The instant invention comprises a bowl having an upper surface which is tapered from a larger opening at the upper end thereof to a smaller opening at the lower end thereof. A first pair of substantially arcuate slip segments are receivable in the bowl. The slip segments have inwardly tapered edges which ride on the bowl inner surface when the segments are received therein for clamping a pipe as the segments are lowered into the bowl. A second pair of substantially arcuate slip segments are receivable in the bowl above the first pair. The second pair of segments have inwardly tapered edges which ride on the bowl inner surface when the second pair of segments are received therein for clamping a pipe as the second pair of segments are lowered into the bowl.

It is an object of the present invention to provide layered pipe slips which grip pipe in an improved manner while reducing the stress generated during gripping.

It is another object of the invention to provide such slips which reduce the above-described uneven loading and pipe bulging which are associated with prior art slips.

These and other objects and advantages of the invention will become more fully apparent when the following detailed description is read in view of the accompanying drawings, wherein.

Figure 1:
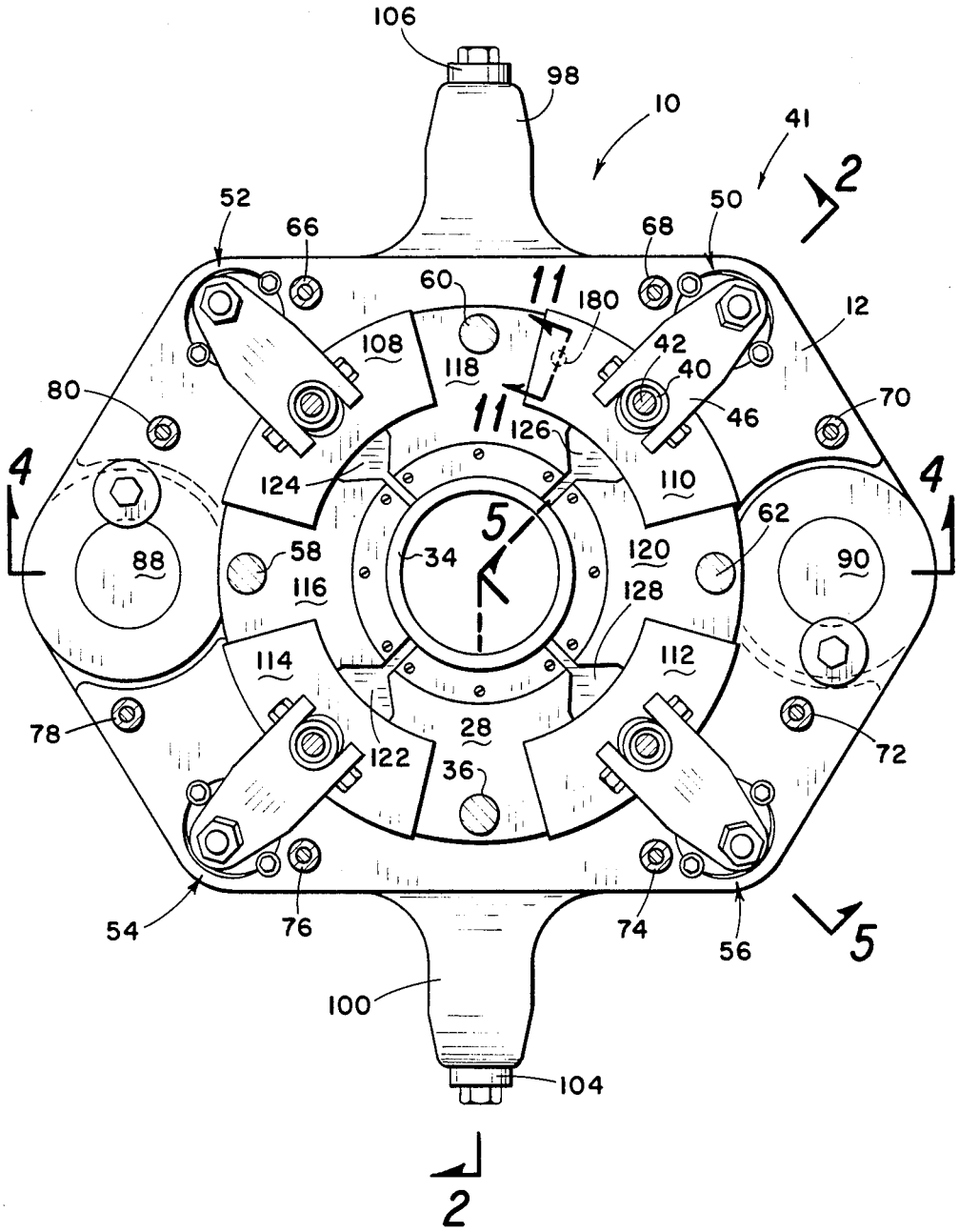
FIG. 1 is a top plan view shown partially in section of a device incorporating the layered pipe slips of the instant invention with the device being configured for use as an elevator, FIG. 1 also being a view taken along line 1—1 in FIG. 2.
Figure 2:
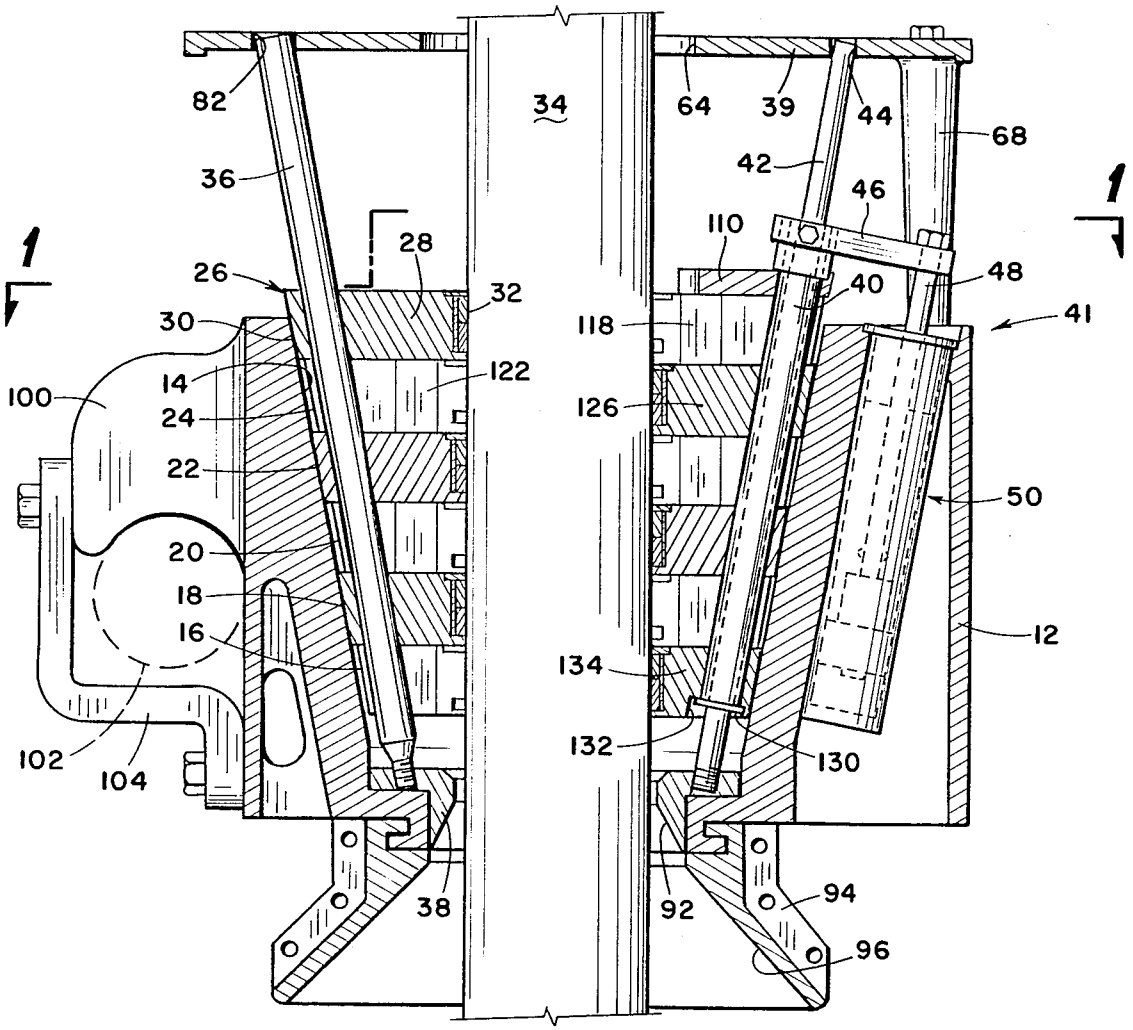
FIG. 2 is a view taken along line 2—2 in FIG. 1.
Figure 3:
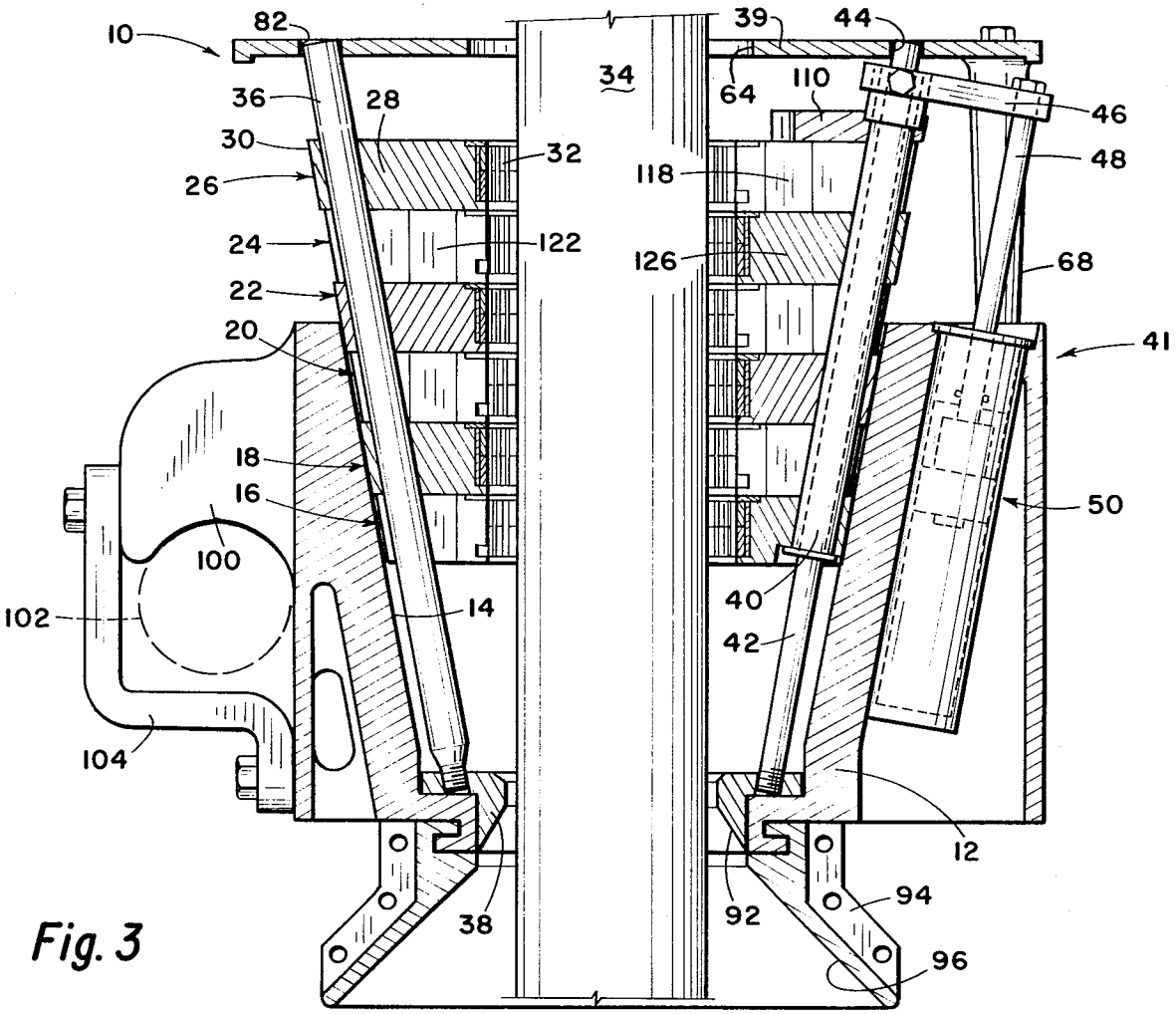
FIG. 3 is a view similar to FIG. 2 showing the device in its opened or non-gripping condition.

Indicated generally at 10 is a device constructed in accordance with the instant invention. In the views of FIGS. 1-3, device 10 is configured to function as an elevator and in operative condition, is suspended from a set of elevator bails on a drilling rig traveling block.

Looking at FIGS. 1 and 2 and considering only generally the structure and operation of device 10, included therein is a bowl or body 12 which includes a tapered inner surface 14 formed about the inner circumference of body 12. The bowl 12 may also be referred to as a support member 12.

First, second, third, fourth, fifth, and sixth layers 16, 18, 20, 22, 24, 26, respectively, of arcuate slip segments, like slip segment 28 in layer 26, are received in and supported by body 12. Slip segment 28 includes a tapered edge or side 30 which abuts against tapered inner surface 14. Gripping elements 32 are mounted on the radially inner surface of segment 28 and grippingly engage a pipe 34. Each of the slip segments in each of the layers has a tapered side, like side 30 of slip segment 28, which abuts against tapered inner surface 14. Each slip segment also includes gripping elements, like gripping element 32, which grippingly engage pipe 34.

A guide rod 36 is received through the layers and is threadably engaged with a guide bottom 38 which is received in the lower end of body 12 as shown. The upper end of rod 36 is supported by a top plate 39 through a bore 82 as shown.

Indicated generally at 41 is slip lifting means. Included therein is tube 40 which is received through each of the layers and has a tube guide rod 42 received therethrough. Tube guide rod 42 is also threadably engaged with guide bottom 38 at its lower end and is supported by top plate 39 through bore 44 as shown.

A yoke 46 connects tube guide rod 42 to a rod 48 of a fluidic ram 50. Ram 50 is connected to a suitable source of fluid supply for extending and retracting rod 48.

As can be seen in FIG. 1, additional slip lifting means 52, 54, 56, like slip lifting means 41, are positioned about the circumference of body 12 ninety degrees from one another. Additional guide rods 58, 60, 62, like guide rod 36, are positioned ninety degrees from one another about the circumference of body 12 adjacent tapered surface 14. Forty-five degrees separates each guide rod from its adjacent slip lifting means.

Speaking now only generally about the operation of device 10, body 12 is suspended from a set of elevator bails, in a manner which will be hereinafter more fully explained, to raise pipe 34 from or lower it into a well bore. With the device in the configuration of FIG. 2, the gripping elements, like gripping elements 32 on segment 28, of each of the segments are abutted against the radially outer surface of pipe 34. The weight of the pipe tends to compress the slip segments into body 12. As the tapered side of each slip segment, like side 30 of segment 28, rides downwardly against tapered inner surface 14 of the body, the segments tend to be urged radially inwardly thus gripping pipe 34 securely.

When pipe 34 and any additional pipe which is threadably engaged therewith is supported below device 10, by, e.g., a spider mounted on the floor of a drilling rig, device 10 may be removed from pipe 34. Such is accomplished by introducing fluid into the lower end of ram 50, and into the lower end of each other ram, which causes the slips to be moved upwardly to the position of FIG. 3. As the tapered slip sides, like side 30, slide upwardly against tapered inner surface 14, the gripping elements, like gripping elements 32, move both upwardly and radially outwardly from pipe 34. Thus, device 10, when in the configuration of FIG. 3, is in condition to be lifted upwardly over the top of pipe 34.

Consideration will now be given in more detail to the structure and operation of device 10. Considering still FIGS. 1–3, plate 39 includes a central bore 64 through which pipe 34 extends. Plate 39 is supported by posts 66, 68, 70, 72, 74, 76, 78, 80, all of which are shown in section in FIG. 1. Post 68 is viewable in FIGS. 2 and 3, posts 70, 80 are viewable in FIGS. 4, and post 72 is viewable in FIG. 5.

Figure 4:
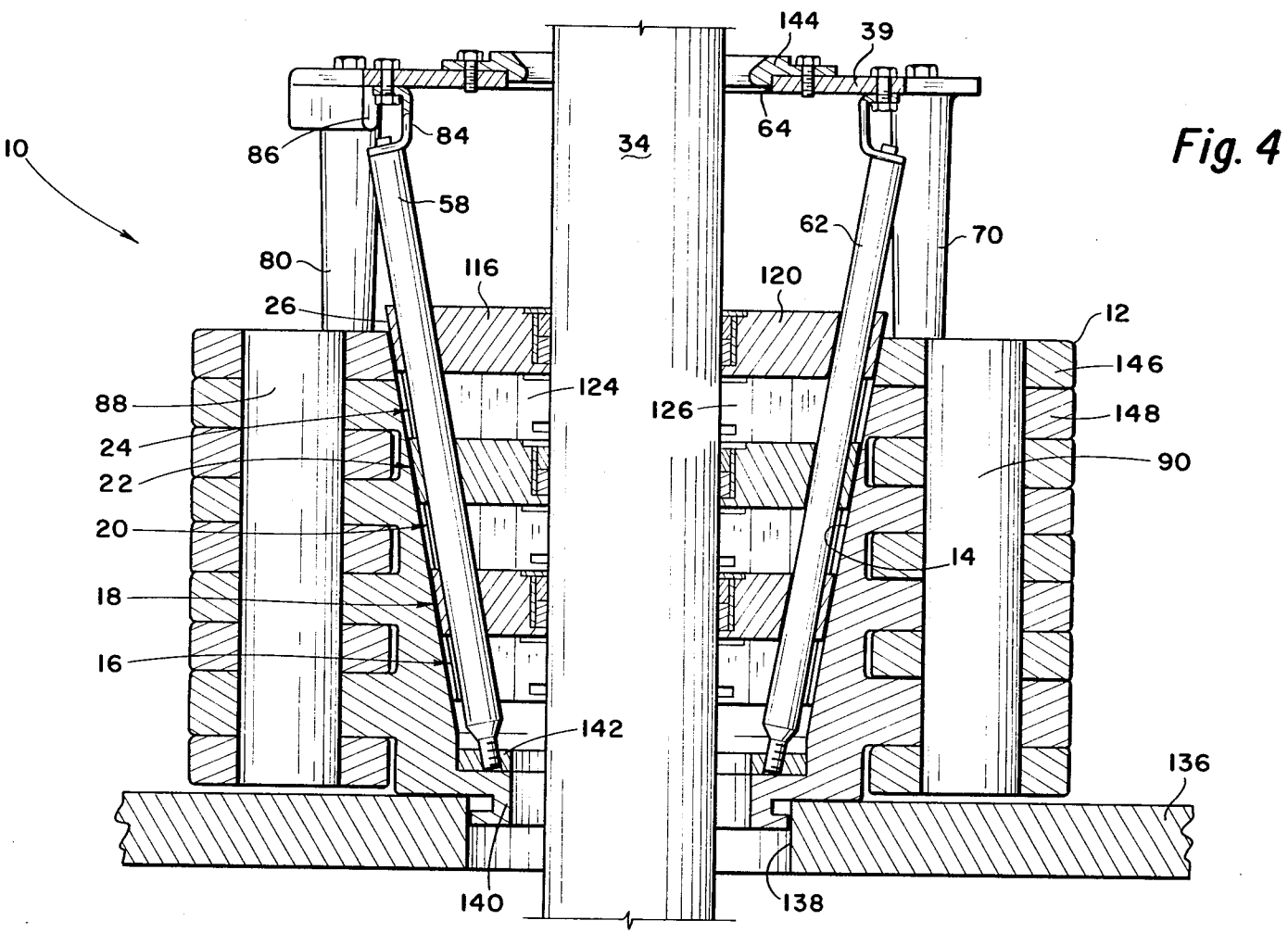
FIG. 4 is a view taken along line 4—4 in FIG. 1 with the device being configured for use as a spider.

Plate 39 includes four bores, like bore 44, each of which receives a tube guide rod, like tube guide rod 42 is received within bore 44. In addition, plate 39 includes two other bores, one of which is bore 82, for receiving two of the guide rods, like guide rod 36 is received within bore 82. The other guide rod which is received within an angled bore (a view of which is not shown) through plate 39 is guide rod 60. Each of the other two guide rods 58, 62 are supported at their upper ends by a bracket, like bracket 84 which is bolted to plate 39 as shown in FIG. 4. Plate 39 includes an opening 86 therein which, as will later become more fully apparent, permits removal of a pin 88 received in body 12 immediately beneath opening 86. Rod 62 is connected to plate 39 via a similar bracket and includes a similar opening to permit withdrawal of a second pin 90.

Guide bottom 38 is fixedly mounted on the lower interior of body 12 as shown. The guide bottom includes a bevel 92 which serves to guide pipe 34 into the body when the slips are in their open configuration as shown in FIG. 3. Each of the tube guide rods, like tube guide rod 42, and the guide rods, like guide rod 36, are threadably received in bores formed in guide bottom 38 as shown in FIG. 2. A stabbing bell 94 having a beveled inner surface 96 is mounted on the lower end of the body. The stabbing bell serves as a guide for pipe approaching the lower end of body 34 and aligns the pipe for entrance into the body.

Body 12 includes a pair of lifting lugs 98, 100 viewable in FIG. 1. Each of the lifting lugs has received thereunder an elevator bail, like elevator bail 102 is received under lug 100 in FIG. 2, which is suspended from the traveling block of a drilling rig and which supports device 10. A bail retainer 104 maintains bail 102 in position beneath lug 100. A similar bail retainer, a portion 106 of which is viewable in FIG. 1, is bolted to lifting lug 98 to maintain its associated bail thereunder.

In FIG. 1, slip retaining plates 108, 110, 112, 114, are each mounted on top of slip layer 26 between adjacent sixth layer slips as shown. As will later be explained more fully, the slip retaining plates maintain the top three slip layers 22, 24, 26 in position when the device is in the open configuration of FIG. 3. In addition to slip segment 28, slip segment layer 26 includes slip segments 116, 118, 120. Fifth slip segment layer 24 also includes four slip segments 122, 124, 126, 128. The structure of the slip segments and the manner in which the segments relate to the guide tubes and guide rods will be discussed more fully hereinafter.

The lower end of tube 40 includes a flange 130 which is abutted against a counterbbre 132 formed in the lower end of a slip segment 134 in first segment layer 16. Each of the other tubes like tube 40 includes a similar flange and is received within a similar counterbore on the underside of one of the first layer slip segments.

Directing attention now to FIG. 4, device 10 therein is configured for use as a spider on a drilling rig floor 136. Floor 136 includes a bore 138 into which a lower portion 140 of body 12 is received. It will be noted that stabbing bell 94, in FIGS. 2 and 3, is omitted when the device is configured for use as a spider as shown in FIGS. 4 and 5.

Another difference in the configuration of the device when used for a spider is that guide bottom plate 38 is exchanged for a substantially planar bottom plate 142. Bottom plate 142 does not include a bevel 92 like that on guide bottom plate 38. Bottom plate 142 includes threaded bores about its circumference to receive the lower threaded ends of guide rods 36, 58, 60, 62, and of each of the tube guide rods, like tube guide rod 42.

Figure 5:
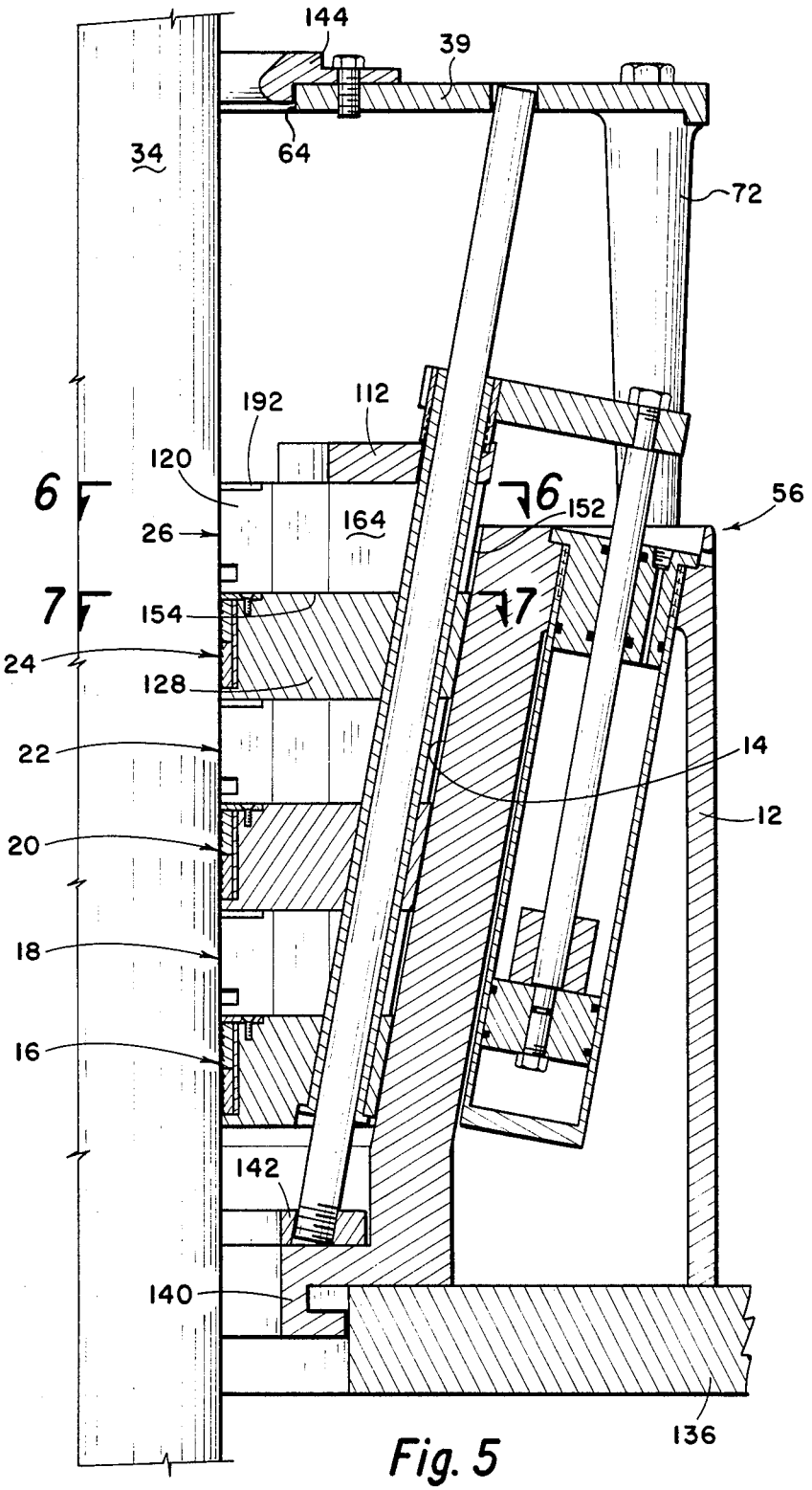
FIG. 5 is an enlarged right side only view taken along line 5—5 in FIG. 1 with the device being configured for use as a spider.

Finally, when the device is configured for use as a spider as in FIGS. 4 and 5, a pipe guide 144 is bolted to plate 39 adjacent bore 64 to assist in guiding pipe entering from above into and through the device.

Although body 12 has been previously referred to herein as if it were a single solid piece it is in fact made up of a pair of symmetrical pieces 146, 148 having an axis of symmetry along line 4—4 in FIG. 1. Pieces 146, 148 include alternate layers which, when moved together as in FIG. 4, form a pair of bores through which pin 88, 90 are received to pin body pieces 146, 148 together for use.

In addition to body 12, guide bottom plate 38 and bottom plate 142 are each split in half to permit body parts 146, 148 to be separated when pins 88, 90 are removed without requiring the plates to be removed from body 12.

Plate 39 is also split in half with one half being carried by posts 66, 68, 70, 80 to permit the body parts to be separated without unbolting plate 39 and its associated posts.

The above-described split body feature is necessary when device 10 is configured for use as a spider and is being used to lower a string of casing pipe into a well bore. After the pipe is lowered and cemented in place, one of pins 88, 90 may be removed and the body hinged open about the other pin in order to remove it from around the casing.

Figure 6:
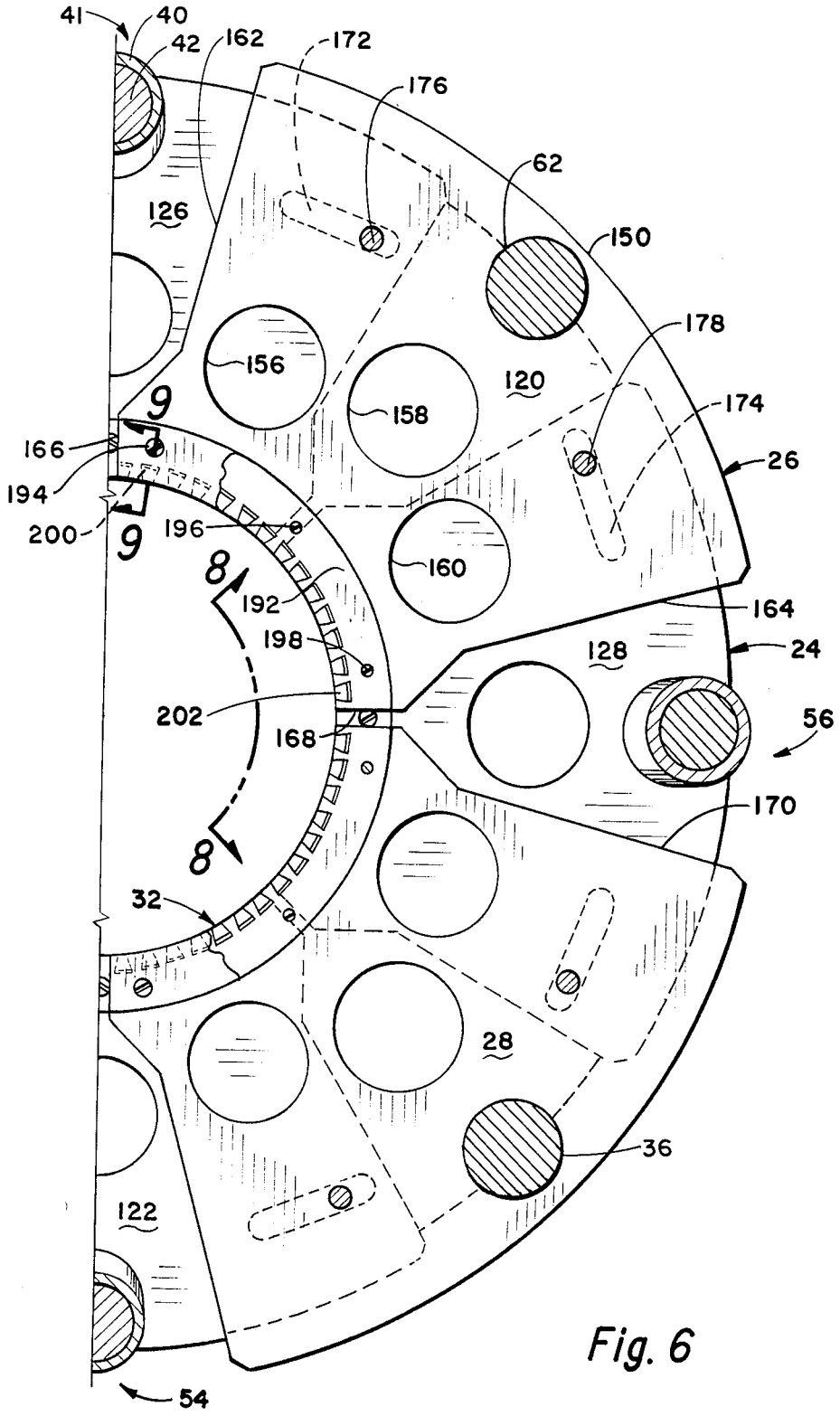
FIG. 6 is an enlarged view taken along line 6—6 in FIG. 5.
Figure 7:
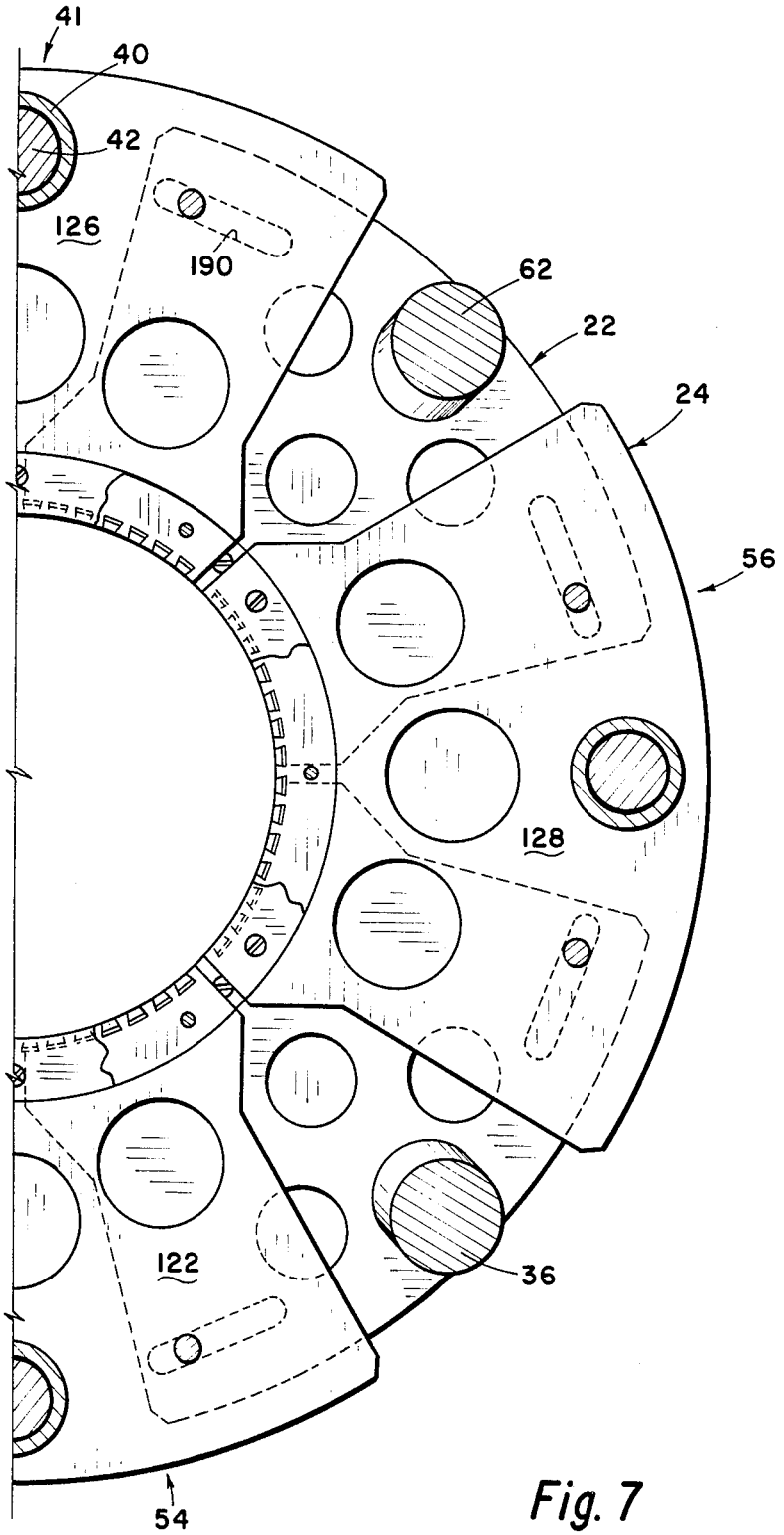
FIG. 7 is an enlarged view taken along line 7—7 in FIG. 5.

Directing attention now to FIGS. 6 and 7, consideration will be given to the structure of the slip segments and the manner in which they are received within body 12. Slip segment 120 includes an arcuate rear edge 150 down from which a tapered side 152 (in FIG. 5) extends. Tapered side 152 is curved so that it is slidingly received against tapered inner surface 14. Slip segment 120 includes a substantially planar bottom 154 (in FIG. 5) which, as seen in FIG. 6, rests partially upon slip segment 128 and partially upon slip segment 126.

Slip segment 120 includes three bores 156, 158, 160 therethrough. Bore 158 is created during the machining process of slip segment 120 and bores 156, 160 are formed to reduce the weight of the slip segment.

The radially outer portion of slip segment 120 includes a pair of sides 162, 164, with side 164 being viewable in FIG. 5. The radially inner portion of slip segment 120 includes a pair of sides 166, 168. It can be seen that when the plane containing side 168 is extended radially outwardly, side 164 defines what is referred to herein as a notch in the arcuate shape of the segment. Slip segment 28 includes a side 170 which when arranged with side 164 of slip segment 120 as shown in FIG. 6 defines a slot in which slip lifting means 56 is received.

Guide rod 62 extends through a bore as shown which is centered between sides 162, 164 in slip segment 120.

Slip segment 120 includes a first groove 172 and a second groove 174 formed on the lower surface thereof. A pair of upstanding screw heads or pins 176, 178 extend upwardly from the upper surface of slip segment 120 with pin 176 being received in a groove (not visible), similar to groove 172, which is formed on the underside of plate 110 in FIG. 1. Similarly, pin 178 is received in a similar groove on the underside of plate 112, also in FIG. 1. Plate 110 has a pin 180 received in a second groove formed on the underside of plate 110 as shown in FIG. 1.

Figure 11:
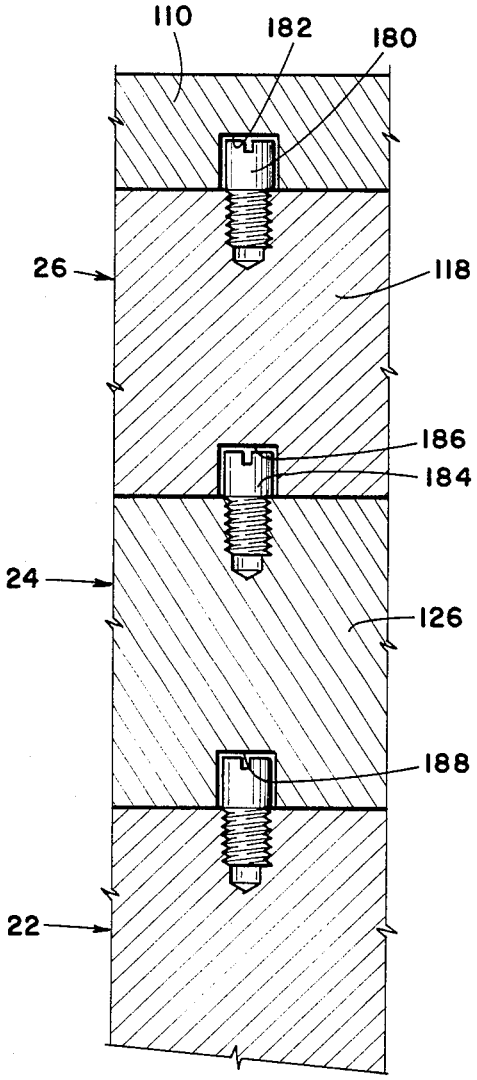
FIG. 11 is an enlarged view taken along line 11—11 in FIG. 1.

For a more detailed view of pin 180 and its associated groove on the underside of plate 110, attention is directed to FIG. 11.

Pin 180 is received in a first groove 182 on the underside of plate 110 which is oriented in the same manner as grooves 172, 174 on slip segment 120. Similarly, pin 184 is received in a groove 186 formed in the underside of slip segment 118. A similar pin is received in a first groove 188 on the underside of slip segment 126 with a second groove 190 on the underside of slip 126 being visible in FIG. 7.

Each of the slip segments in layers 22, 24, 26, include a pair of upstanding pins, as previously described, which are received in grooves as shown formed on the underside of the upper adjacent slip segments with the pins on the slip segments in layer 26 being received in grooves formed on the underside of plates 108, 110, 112, 114. As will be later more fully explained, the above-described pin and groove system serves to assist in uniformly spreading each of the slip segments when the device moves from the closed position of FIG. 2 to the open position of FIG. 3. The slot and pin system also prevents slips in upper layers 22, 24, 26 from rotating about the tube or guide rod over which the slip segment is received.

Each of the slip segments on a given layer are substantially identical in structure and size to one another and can be interchanged. However, the segments in different layers cannot be interchanged with one another because, as can be seen in the cross-sectional elevational views of FIGS. 2–5, the distance between the gripping elements on the radially inner surface of each slip segment and the tapered side, like side 152, which abuts against surface 14 of the body gradually decreases from the top slip segment layer to the bottom slip segment layer.

The arrangement of the slip lifting means, like slip lifting means 41, and the guide rods, like guide rod 36, with each of the slip segment layers is as follows. As shown in FIG. 2, each of the slip lifting means includes a tube, like tube 40 in slip lifting means 41. Each tube includes a flange, like flange 130, on the lower end thereof which is received within a counterbore on the lower surface of each of the four slip segments in segment layer 16, the lowermost layer. Each of the segments in the lowermost layer include (as do all segments) opposing sides, like sides 162, 164 of slip segment 120 in FIG. 6, which when the segments are received over their associated tubes define four slots through which each of the guide rods, like guide rod 36 extend. In slip layer 18, the layer immediately above layer 16, a guide rod passes through the central bore of each of the slip segments while the tubes pass through the notches defined by opposing slip segment sides. In layer 20 the tubes again pass through the central bore in each of the slip segments while the guide rods pass through the notches and so on. Thus, as can be observed in FIGS. 6 and 7, each guide rod and tube passes through a series of alternating notches and slip segment bores.

Consideration will now be given to the structure of the pipe gripping elements, like gripping elements 32, and the manner in which they are connected to their associated slip segment. Each slip segment, like slip segment 120 in FIG. 6, includes an arcuate plate 192 which is received in a recess formed on the upper surface of slip segment 120 about the radially inner circumference thereof. This recess with plate 192 received therein is best viewed in FIG. 5.

The plate is secured via screws 194, 196, 198 with a portion of the plate and screws 196, 198 being broken away in the view of FIG. 6. A plurality of inserts, like inserts 200, 202 are received in dove tail slots which extend downwardly from the upper surface of segment 120 at its radially inner edge.

Figure 10:
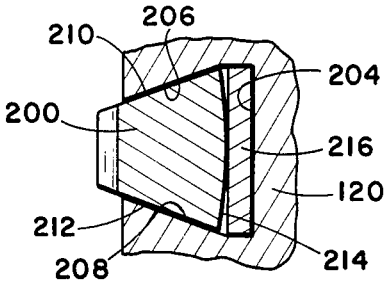
FIG. 10 is a view taken along line 10—10 in FIG. 9.
Figure 9:
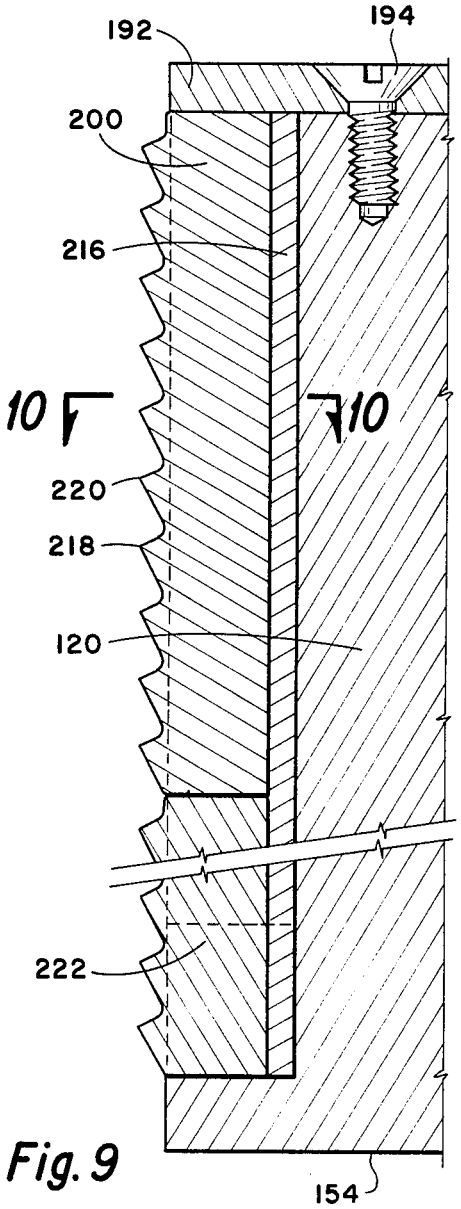
FIG. 9 is an enlarged view taken along line 9—9 in FIG. 6.

FIGS. 9 and 10 provide a detailed view of insert 200 and a slot in which it is received. The dove tail slot comprises a back wall 204 and a pair of opposing side walls 206, 208 which taper toward one another. Insert 200 includes sides 210, 212 which are abutted against side walls 206, 208, respectively. Insert 200 includes a slightly curved base or rear 214, the middle of which is received against an aluminum spacer 216. Aluminum spacer 216 is substantially rectangularly shaped and extends from the top of the slot in which insert 200 is received to the bottom. Insert 200 includes a plurality of upwardly directed teeth, two of which are teeth 218, 220, to assist in gripping the surface of the pipe. A second insert 222 is received in the same slot as insert 200 and is positioned therebeneath. Each of the inserts are substantially identical to one another.

It is to be appreciated that each of the other inserts and each of the other slots in the slip segments is substantially identical to the slot and inserts described in FIGS. 9 and 10.

Figure 8:
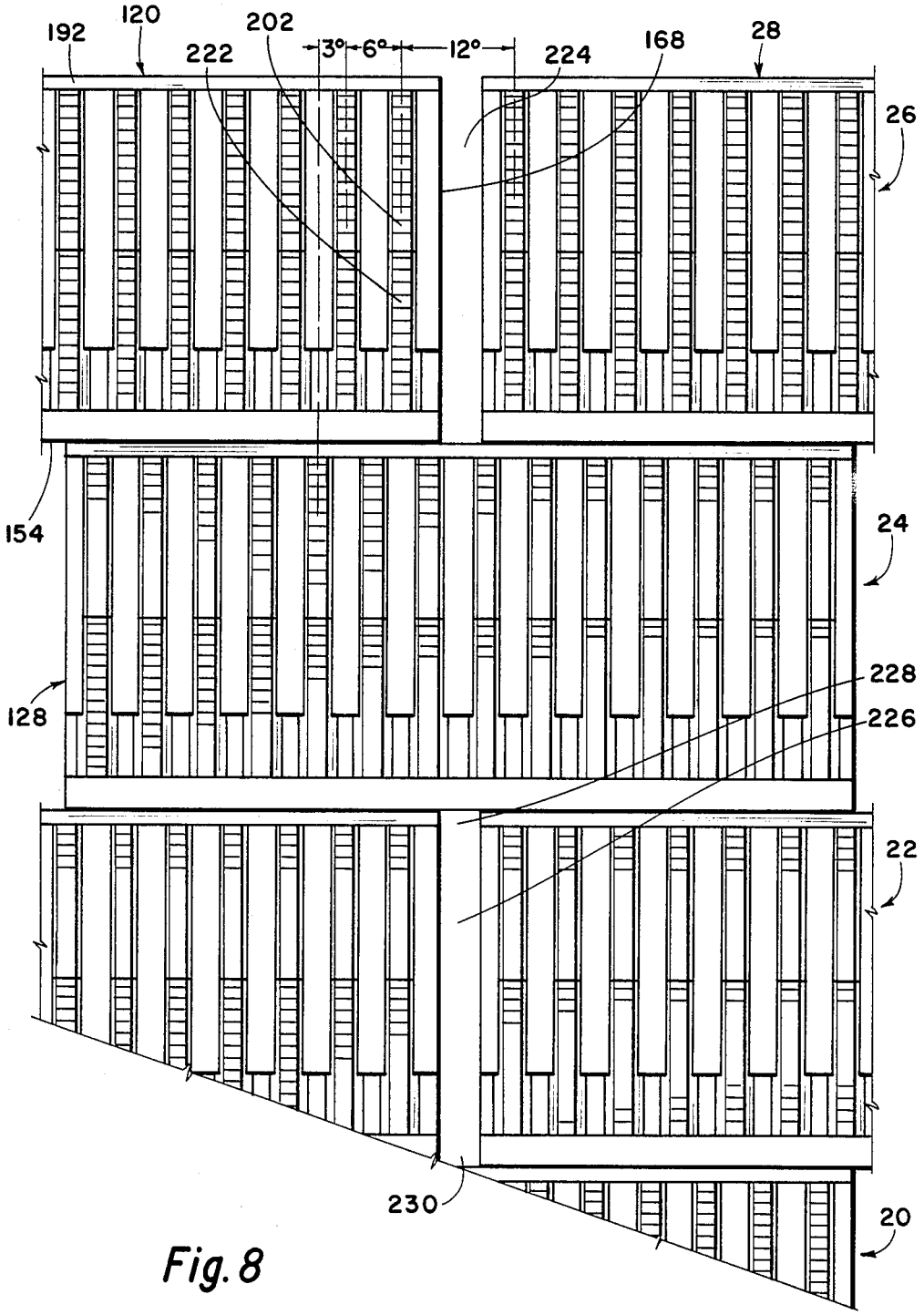
FIG. 8 is an enlarged view taken along line 8—8 in FIG. 6.

For consideration of the relationship of each of the inserts to one another, attention is directed to FIG. 8. It can be seen that in the instant embodiment of the invention, the longitudinal axis of each insert is positioned six degrees about the radially inner circumference of the slip segment from the longitudinal axis of the adjacent insert.

It can also be seen in slip layer 26 that a gap 224 exists between adjacent slip segments 28, 120. A similar gap 226 exists between the adjacent slip segments in layer 22 in FIG. 8. Gap 226 includes an upper end 228 and a lower end 230.

In the instant embodiment of the invention there is twelve degrees between the longitudinal axes of inserts which are adjacent facing sides of adjacent slip segments.

It should be noted that the longitudinal axes of the inserts on layer 24 are offset by three degrees from those on layer 26. Thus, the staggering of insert axes prevents there from being a plurality of longitudinal gaps between inserts. The staggering of slip segments prevents there from being a substantial gap which extends across the segment layers between adjacent segments.

The relationship of the slip segments of adjacent layers can be generally described as follows. In the embodiment illustrated, each of the layers 16–26 has four slip segments; thus there is $360/4=90°$ between the gaps 224 in slip layer 26. Preferably the gaps between slip segments of the adjacent layer 24 are staggered relative to layer 26 so as to place the gaps of layer 24 equidistant between gaps 224 of layer 26. Thus the gaps of layer 24 are offset by $90/2=45°$ from gaps 224 of layer 26. This can be generally stated by saying that the gaps of layer 24 are offset by 360/2N degrees from the gaps 224 of layer 26, where N is the number of segments in a layer.

In operation, considering the device configured for use as an elevator as shown in FIGS. 2 and 3, when it is desired to release pipe 34 from being grasped by the slip segments as shown in FIG. 2, fluid is introduced to the lower end of each of the four rams, like ram 50, thus causing each of the tubes, like tube 40, to be raised to an upper position as shown in FIG. 3. When the tubes are so raised, each of the segments in layer 16 is lifted upwardly due to the action of flange 130 (in FIG. 2) on the underside of the slip segment. Such lifting tends to raise the slip segments in layer 18 which in turn raises those on layer 20 and so forth. Each of the slip segments slides against tapered inner surface 14 and against the segments in the adjacent layer as upward movement occurs thus causing the gripping elements on the radially inner surface of the segments to move radially outwardly from pipe 34. As the slip segments are raised, each of the pins, like pins 176, 178 in FIG. 6, which are received in a groove on the underside of the adjacent upper slip segments (or plates as in the case of the upper layer of segments), slides along the groove to permit radially outward movement of the segments.

With each pin received in its associated groove, when layers 24, 26 are raised completely above surface 14 with layer 22 being raised partially thereabove, pivoting of slips in these layers about their associated tubes and guide rods cannot occur due to the restraining action of the pin and groove system.

When it is desired to grip a pipe received in device 10, fluid is introduced to the upper portion of each of the rams thus driving the slip segments downwardly and back to the configuration of FIG. 2.

The groove and pin system maintains the upper segments in alignment so that they may be received within the body responsive to downward movement of the ram rods.

When the pipe is so clamped, each of the inserts is pushed against its associated aluminum spacer, like insert 200 is pushed against spacer 216 in FIGS. 9 and 10. Since the inserts and slip segments are made of steel which has a modulus of elasticity of about 30 million and spacer 216 is made of aluminum which has a modulus of elasticity of about 10 million, the aluminum strip may be subject to a certain amount of deformation to enable the pressure against each insert to be substantially equalized among all of the inserts. Thus, for example, if there is a slight pipe deformation in the nature of a bumb or bulge, the insert or inserts which abut thereagainst will compress their associated aluminum strip more so than the other inserts thus permitting the other inserts to bear against the radially outer surface of the pipe.

Since the aluminum includes a certain amount of springiness, it will return to its original configuration when the load is reduced, assuming the load is not sufficient to exceed the yield point of the aluminum. Most pipe deformations likely to be encountered are not of a size which will exceed the yield point of the aluminum spacers.

It is to be appreciated that additions and modifications to the embodiments disclosed herein could be made without departing from the spirit of the invention which is defined in the following claims.

We claim:

1. Apparatus for supporting a pipe in a vertical position comprising:

a support member having an upper surface and a lower surface and a passage formed therethrough between said upper and lower surfaces, said passage having an inwardly tapered surface between said upper and lower surfaces;

a first pair of substantially arcuate slip segments receivable in said passage, said slip segments having inwardly tapered edges which ride on said tapered surface when said segments are so received for clamping a pipe in said passage as said segments are lowered therein; and a second pair of substantially arcuate slip segments receivable in said passage above said first pair, said second pair of segments having inwardly tapered edges which ride on said tapered surface when said second segments are so received for clamping a pipe in said passage as said second segments are lowered therein; wherein when said first and second segment pairs are so received, said first pair of segments are opposite one another, said second pair of segments are opposite one another and said first pair is staggered relative to said second pair.

2. The apparatus of claim 1 wherein said apparatus further includes a guide rod received in said passage and wherein one of said slip segments includes a bore therethrough through which said rod is received.

3. The apparatus of claim 1 wherein said apparatus further includes means for urging said slip segments upwardly relative to said support member.

4. The apparatus of claim 3 wherein said urging means further comprises an elongate member having one end supportingly engaged with one segment of said first pair of segments and extending upwardly therefrom.

5. The apparatus of claim 4 wherein said elongate member comprises a tube and wherein said apparatus further includes a tube guide rod over which said tube is received.

6. Apparatus for clamping a pipe in a vertical position, said apparatus in operative condition comprising:

a bowl having an inner surface which tapers from a larger opening at the upper end thereof to a smaller opening at the lower end thereof, said openings having a pipe received therethrough;

a first layer of substantially coplanar arcuate slip segments having tapered edges abutted against said bowl inner surface, said slip segments defining a plurality of gaps between adjacent segments;

a second layer of substantially coplanar arcuate slip segments having tapered edges abutted against said bowl inner surface, said second layer slip segments defining a plurality of gaps between adjacent second layer segments, said second layer gaps being offset from said first layer gaps; and .

gripping members mounted on the radially inner surface of each of said slip segments, said gripping members abutting against the radially outer surface of said pipe.

7. The apparatus of claim 6 wherein said first and second layers abut against one another.

8. The apparatus of claim 6 wherein said apparatus further includes a third layer of substantially coplanar arcuate slip segments having tapered edges abutted against said bowl inner surface, said third layer segments defining a plurality of gaps between adjacent third layer segments, said third layer gaps being offset from said second layer gaps.

9. The apparatus of claim 8 wherein said first layer gaps and said third layer gaps are in line with one another.

10. The apparatus of claim 8 wherein said apparatus further includes additional layers of substantially coplanar arcuate slip segments having tapered edges abutted against said bowl inner surface, the segments on each layer defining a plurality of gaps between adjacent segments and the gaps in adjacent layers being offset from one another.

11. The apparatus of claim 10 wherein said apparatus further includes means for sliding said slip segments along the inner surface of said bowl toward the upper end thereof.

12. The apparatus of claim 11 wherein said sliding means comprises a plurality of elongate members each having a lower end supportingly engaged with a first layer segment and extending upwardly therefrom substantially parallel to said bowl inner surface.

13. The apparatus of claim 12 wherein said segments include notches on the radially outer portion thereof to accomodate said elongate members.

14. The apparatus of claim 13 wherein said segments include bores therethrough through which said elongate members are received.

15. The apparatus of claim 14 wherein the bores in each segment layer are vertically aligned with the notches in each adjacent segment layer.

16. The apparatus of claim 12 wherein each of said elongate members further comprises:

a rod mounted on the lower portion of said bowl adjacent said smaller opening and extending upwardly therefrom substantially parallel to said bowl inner surface; and a tube slidingly fitted over said rod and having a lower end mounted on a first layer segment.

17. Apparatus for gripping pipe in a vertical position, said apparatus, in operative condition, comprising:

a bowl having an opening at the upper and lower ends thereof through which a pipe is received, said bowl having an inwardly tapered surface formed between said upper and lower openings;

a plurality of layers of substantially coplanar arcurate slip segments each having a tapered edge formed on the radially outer surface thereof which abuts against said bowl inner surface;

a plurality of gaps in each layer, said gaps being defined by a space between the ends of adjacent segments, said gaps being offset by substantially 360/2N degrees, where N is the number of segments in a layer, between adjacent layers; and gripping members mounted on the radially inner surface of each of said slip segments, said gripping members abutting against the radially outer surface of said pipe.

18. The apparatus of claim 17 wherein each of said gripping members comprises an elongate insert having a vertical row of teeth presented toward said pipe.

19. The apparatus of claim 18 wherein said inserts on adjacent segment layers are offset from one another.

20. The apparatus of claim 19 wherein the longitudinal axis of an insert on one layer is half way between the longitudinal axes of inserts on an adjacent layer.

21. The apparatus of claim 17 wherein said gripping members on one layer abut against said pipe at an end of said gap on an adjacent layer.

22. The apparatus of claim 17 wherein each segment includes a bore therethrough half way between the ends thereof, said bore having an axis parallel to said tapered bowl surface.

23. The apparatus of claim 22 wherein each segment includes a notch formed in the radially outer surface thereof at each segment end, said notches at adjacent segment ends defining a slot which is aligned with a segment bore on an adjacent layer.

24. The apparatus of claim 23 wherein said apparatus further includes means for sliding said segments upwardly in said bowl.

25. The apparatus of claim 24 wherein said sliding means comprises a plurality of elongate members each being received in an aligned series of bores and slots and having a lower end mounted on a segment in the lowermost layer.

26. The apparatus of claim 25 wherein said apparatus further includes means for lifting said elongate members.

27. The apparatus of claim 26 wherein said apparatus further includes a plurality of guide rods received in an aligned series of bores and slots and having a lower end mounted on said bowl beneath said lowermost layer, said guide rods alternating with said elongate members around said bowl.

* * * * *